United States Patent [19]

Schulenberg et al.

[11] Patent Number: 4,685,204

[45] Date of Patent: Aug. 11, 1987

[54] ARRANGEMENT FOR DRAWING TRANSVERSE RIBS

[75] Inventors: Heinrich Schulenberg; Otto Wisse, both of Bochum, Fed. Rep. of Germany

[73] Assignee: GEA Luftkuehlergesellschaft Happel GmbH & Co., Bochum, Fed. Rep. of Germany

[21] Appl. No.: 809,518

[22] Filed: Dec. 16, 1985

[51] Int. Cl.[4] ..... B23P 21/00

[52] U.S. Cl. ..... 29/726; 192/91 A

[58] Field of Search ..... 29/726, 33 G, 157.3 B; 192/91 A, 46, 47, 108

[56] References Cited

U.S. PATENT DOCUMENTS

| | | | |
|---|---|---|---|
| 2,618,366 | 11/1952 | Bryant | 192/91 A |
| 3,095,639 | 7/1963 | Seien | 29/726 |
| 3,306,409 | 2/1967 | Giometti | 192/46 |
| 3,498,151 | 3/1970 | King | 192/46 |
| 3,679,032 | 7/1972 | Bennett | 192/91 A |
| 3,798,732 | 3/1974 | Schulenberg et al. | 29/726 |
| 3,815,203 | 6/1974 | Schulenberg et al. | 29/726 |

*Primary Examiner*—Daniel C. Crane

*Attorney, Agent, or Firm*—Michael J. Striker

[57] ABSTRACT

An arrangement for drawing transverse ribs onto smooth pipes, comprises a punch arranged to produce transverse ribs; a drive provided for driving the punch; a drawing bank carrying smooth pipes to be provided with ribs; driving chain means movable from the punch drive and including at least two continuously rotatable endless driver chains extending at a distance from one another and driving the transverse ribs; driving chain wheels arranged for driving the driver chains at their one end, the driving chain wheels having a driving shaft; and a coupling provided between the punch drive and the driving chain wheels at a drawing bank end which is opposite to the punch, the coupling including two claw discs which are bringable in form-locking and force-transmitting engagement with one another, one of the claw discs being freely rotatably arranged on the driving shaft on the driving chain wheel and at least indirectly actuatable from the punch drive, the other of the claw discs being connected with the driving shaft for joint rotation therewith, the other claw disc being axially displaceable under the action of a spring force in one axial direction and under the action of a fluid in the other axial direction on the driving shaft.

15 Claims, 2 Drawing Figures

ARRANGEMENT FOR DRAWING TRANSVERSE RIBS

BACKGROUND OF THE INVENTION

The present invention relates to an arrangement for drawing transverse ribs on smooth pipes.

Arrangements of the above mentioned general type are known in the art. A known arrangement has a punch for producing transverse ribs, a drawing bank which carries smooth pipes to be provided with ribs, a driver chain transmission including at least two endless driver chains driveable from a punch drive over chain wheels and provided with drivers for transverse ribs, and a coupling arranged between the punch drive and the driving chain wheels of the driver chains. In such arrangements it is a problem to bring the drivers connected with the driver chains and provided for displacing transverse ribs for the punch, again to an exact taking position after disengagement of the driver chains from the punch drive, for example for the purpose of adjusting or when failures of the ribbing process take place. The coupling provided in this arrangement for this purpose is formed as a friction coupling in the drive train between the punch drive and the driving chain wheels located at the punch side of the drawing bank. By means of such a friction coupling it was also possible only with special labor and skill to bring the drivers to the proper receiving position during a repeated process. Additional difficulties take place when the ribs have different geometry.

SUMMARY OF THE INVENTION

Accordingly, it is an object of the present invention to provide an arrangement of the above mentioned type which after repeated stoppages of the driver chains can guarantee the orderly position of the drivers for taking the punched transverse ribs during resumption of the operation, regardless of the geometry of the ribs.

In keeping with these objects and with others which will become apparent hereinafter, one feature of the present invention resides, briefly stated, in that the coupling provided at the drawing bank and particularly at its end opposite to the punch has two claw discs which are bringable in form-locking and force-transmitting engagement with one another, where one claw disc is freely rotatable on the driving shaft of the driving chain wheels and at least indirectly driveable from the punch drive, for example via a driving wheel, while the other claw disc is arranged on the driving shaft for joint rotation therewith but axially displacably relative to the driving shaft in one axial direction under a spring action, for example of a spring, and in the other axial direction under fluid action, for example, of fluid-actuated cylinder-piston unit.

The advantage of this arrangement is that now the coupling is arranged at the end of the drawing bank, which is opposite to the punch. In this case, the chain wheels located at this end can de driven and thereby the driver chains with the drivers which guide the transverse ribs are pulled. The process of applying the ribs takes place without jolts, even with very long smooth pipes to be ribbed (15 m and more) and also in the event of several pipes which are to be ribbed near one another up to approximately 10 pipes). The quality of the pipes is decisively improved.

Since the claw discs are bringable in form-locking and force-transmitting connection with one another, in connection with the axial displaceability of one of the claw discs on the driving shaft of the driving chain wheels, it is guaranteed that after the separation of both claw discs and subsequent engagement, always the proper driver position relative to the working cycle of the punch is available. By simple exchange of the claw discs the number of the claws can be changed, whereby a respective geometery of the ribs can be taken into consideration. The engagement of the claw discs is guaranteed by the mechanical spring force, while the fluid-operated cylinder-piston unit serves for disengagement of the claw discs from one another. As a result of this, only by the desired actuation of the cylinder-piston unit, an uncoupling of the driver chains from the punch drive can be performed.

In accordance with a further feature of the present invention, the claws are arranged at the end side of each claw disc, and each claw is formed by two axially extending driving surfaces as well as a rectilineat transition surface extending between two driving surfaces at a small inclination relative to the plane normal to the axis of the driving shaft. In this construction it is guaranteed that driving of the driving shaft is performed only in one rotary direction. The toothing of the claw discs is formed in a zig-zag manner and has relatively short driving surfaces as compared with the length of the transition surfaces. Since the claws are provided at the end side of the claw discs, the coupling can be formed without projections in the circumferential direction.

In accordance with a further feature of the present invention the spring is formed as a helical pressure spring and arranged between a cup-disc which is supported at the end of the driving shaft, on the one hand, and a flange of the cylinder of the cylinder-piston unit which engages the cup-disc and is connected with the rotary-fixed claw disc and the cylinder. In this construction the helical pressure spring and the cup-disc are located in a protected manner inside the flange connected with the cylinder. The connection of the flange with the associated rotary-fixed claw disc can be performed by uniformly circumferentially distributed screws.

Still a further feature of the present invention is that the rotary-fixed connection of the driving shaft with one of the claw discs is performed by a groove-spring structure formed between the driving shaft and the flange. This is only an advantageous embodiment, since this connection can be performed by other means as well. As for the groove-spring structure, the driving shaft is provided with a groove in which a spring is located. The flange has an opening with a longitudinal groove which guarantees the rotary-fixed connection of the flange with the driving shaft and as a result with the claw disc. However, the axial displacement of the flange and the claw disc is provided.

The cup-disc can abut against a clamping ring which is fixed at one end of the driving shaft. This provides easy mounting and demounting of the helical pressure spring. Also the cup-disc can favorably maintain the spring constant of the helical pressure spring so that the additional mounting space is not necessary.

The cylinder of the cylinder-piston unit can be fixed on a cover disc which is mounted on the flange, and a piston rod can extend through the cover disc in direction toward the end surface of the driving shaft. The cover disc here closes the interior of the flange. Simultaneously, the cover disc serves for fixing the cylinder on the flange. For this purpose, screw can be uniformly distributed in a circumferential direction. The cylinder is screwed centrally into the cover disc. This facilitates the maintenance. The piston rod projects beyond the cover disc and in the extended position extends in the cup-disc. During actuation of the cylinder-piston unit, the piston rod is extended and supports against the end surface of the driving shaft, so that the claw discs, the flange, the cover disc, and the cylinder are displaced relative to the driving shaft.

Finally, the cylinder-piston unit is pneumatically actuatable and coupled with a pneumetic rotary throughbearing or conduit. This is an especially advantageous embodiment for the specific conditions of the rib drawing machines. In addition to the pneumatically actuated cylinder-piston unit, also a hydraulically actuated cylinder-piston unit can be used. Also, an electromagnetic cylinder can also be provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
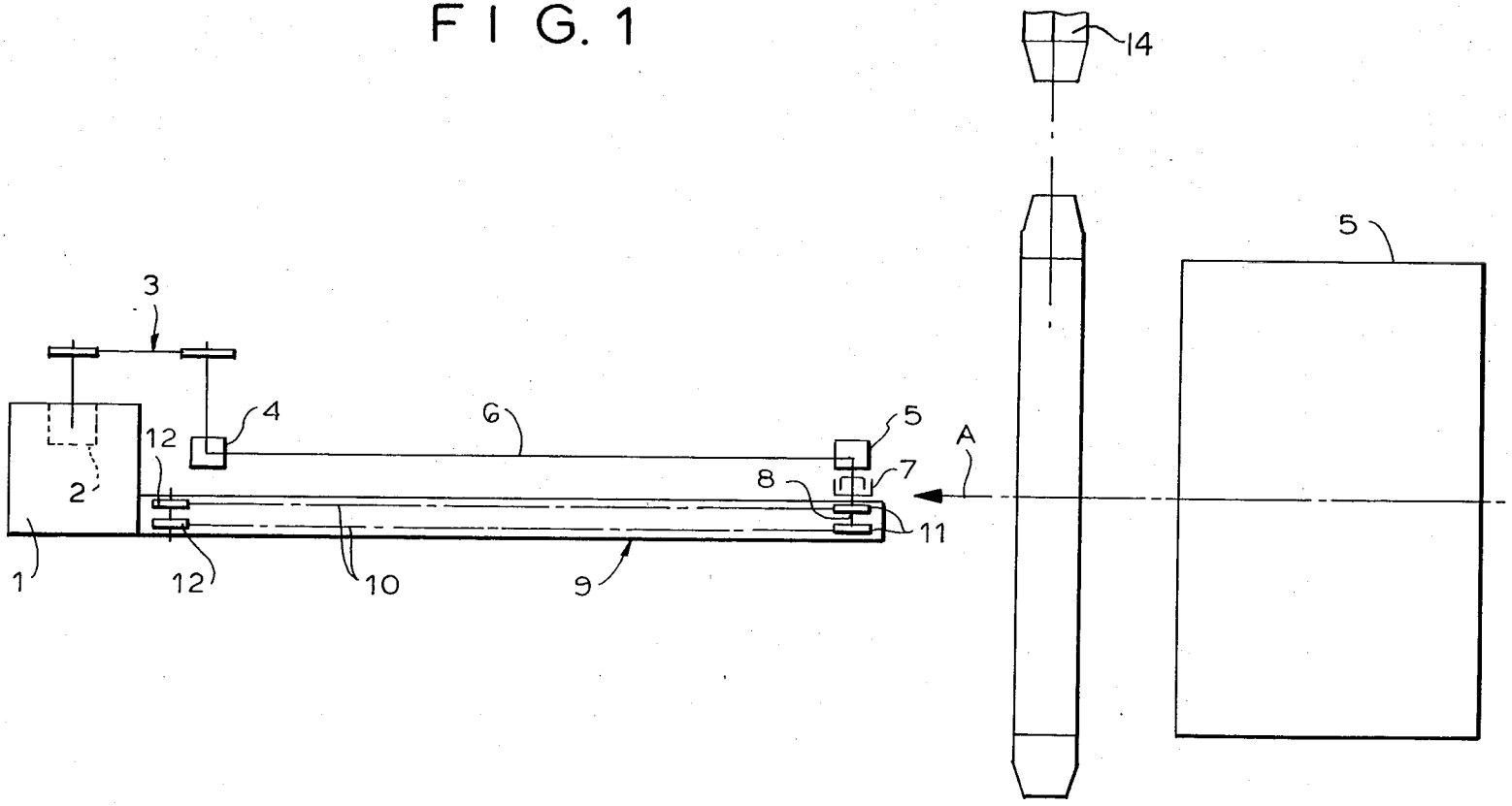
FIG. 1 is a view showing an arrangement for drawing transverse ribs onto smooth pipes, in a schematic illustration.

An arrangement for drawing transverse ribs on smooth pipes includes a punch which punches desired transverse ribs from sheet plates and is identified in FIG. 1 with reference numeral 1. reference numeral The punch 1 has a punch drive identified with reference numeral 2. A drawing bank is identified with reference numeral 9.

A chain transmission 3 is connected with the punch drive 2. It drives two driver chains 10 which rotate in vertical planes, via two angular transmissions 4, 5, hollow shaft 6 arranged between the angular transmissions 4, 5, a coupling 7, and a drive shaft 8 located at the end of the drawing bank 9 opposite to the punch 1. The driving chains 10 are guided over driving chain wheels 11 and deviating chain wheels 12 arranged at opposite ends of the drawing bank 9. The deviating chain wheels 12 can be supported displaceably in the longitudinal direction of the drawing bank 9 so as to allow tensioning of the driver chains 10.

Not shown, drivers are arranged on the driver chains 10. They take the transverse ribs produced by the punch 1 in the region of the punch and move them onto smooth pipes which are arranged on the drawing bank 9 and not shown in the drawing. Up to ten smooth pipes can be simultaneously provided with ribs near one another. The smooth pipes can have a length of 15 m and more.

The procedure of drawing transverse ribs onto smooth tubes and specifics of the driving mechanism are disclosed in U.S. Pat. No. 3,095,639 which is incorporated here by reference.

Figure 2:
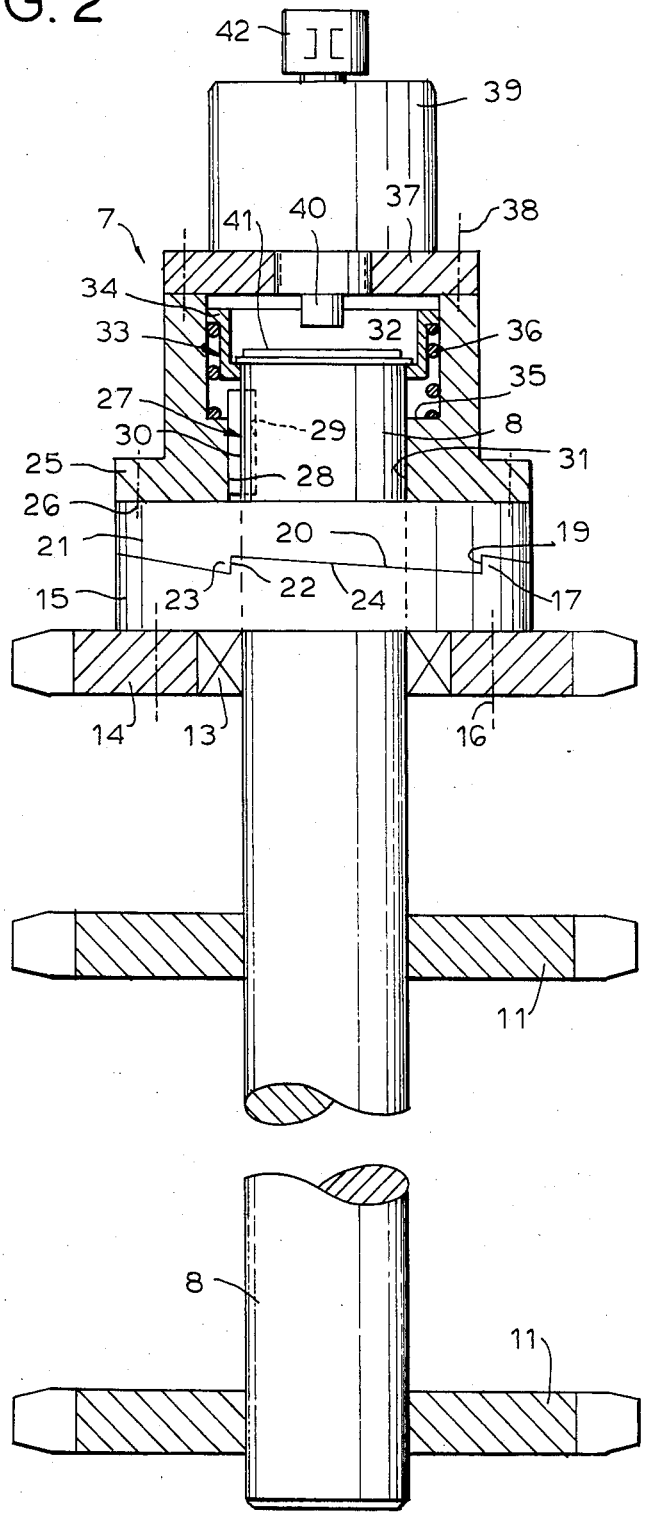
FIG. 2 is an enlarged view, partially in section, of a coupling used in the arrangement of FIG. 1, in accordance with the present invention.

A coupling 7 shown in detail in FIG. 2 is provided between the angular transmission 5 and the driving shaft 8. It uncouples the driver chains 10 from the punch drive 2 when it is necessary to perform adjusting works or when failures take place.

The coupling 7 first of all includes a chain wheel 14 which is freely rotatably supported on the driving shaft 8 via a roller bearing 13. The chain wheel 14 is immovable relative to the driving shaft 8 in the axial direction. A driving chain 14' is guided over the chain wheel 14 and connected with an output shaft of the angular transmission 5. This arrangement is formed in that in practice the angular transmission 5 is located deeper than the driving shaft 8.

A claw disc 15 is fixedly connected with the chain wheel 14. The connection is performed by means of screws 16 which are uniformly distributed in a circumferential direction. The claw disc 15 has end-side claws 17 which are formed by short driving surface 19 extending parallel to the axis 18 of the driving shaft 8, and also by rectilinear surfaces 20 which extend between two driving surfaces 19 with a small inclination relative to a plane extending transverse to the axis 18 of the driving shaft.

A further claw disc 21 is formed so as to be coupled only in a rotary direction with the claw disc 15 which rotates freely on the driving shaft 8. The claw disc 21 also has claws 23 having driving surfaces 22 which extend parallel to the axis 18 of the driving shaft 8 and inclined transition surfaces 24. The claw disc 21 is connected with a hollow flange 25 by screws 26 which are uniformly distributed in a circumferential direction. The claw disc 21 is also connected with the driving shaft 8 for joint rotation therewith, but axially displaceable relative to the driving shaft 8. This connection is performed by a groove-spring arrangement 27. The claw disc 21 is therefore displaceable axially and relative to the claw disc 16. The groove-spring arrangement 26 includes a spring 28 which is mounted in a groove 29 of the driving shaft 8, and also a longitudinal groove 30 in an opening 31 of the hollow flange 25.

A clamping ring 32 is fixed at one end of the driving shaft 8. A cup-disc 33 supports on the clamping ring 32. A helical pressure spring 36 is arranged between a radial collar 34 of the cup-disc 33 and a bottom 35 of the hollow flange 25. The helical pressure spring 36 serves for bringing the claw disc 21 into engagement with the claw disc 15 and holding the engagement.

A cover disc 37 is mounted on the hollow flange 25 by means of circumferentially uniformly distributed screws 38. A cylinder 39 of a pneumatically operating cylinder-piston unit is screwed centrally into the cover disc 37. A piston rod 40 of the cylinder-piston unit extends into the cup-disc 33 and ends in the withdrawn ready position before an end surface 41 of the driving shaft 8.

When the working medium is supplied into the cylinder 39 through a pneumatic rotary throughbearing 42, the piston rod 40 comes to abutment against the end surface 41 of the driving shaft end so that the cylinder 39 together with the cover disc 37, the hollow flange 25 and the claw disc 21 is displaced relative to the driving shaft 8 and engages the claw discs 21 and 15 with one another.

When the actuation of the cylinder-piston unit is terminated, the helical pressure spring 36 presses the claw discs 21 and 15 again toward one another so as to provide form-locking and force- transmitting connection, and thereby the drivers on the driver chains 10 take up the transverse ribs produced by the punch 1 exactly at a predetermined location which is dependent on the position and number of the claws 17, 23 and displace the transverse ribs without jolts onto the smooth pipes.

It will be understood that each of the elements described above, or two or more together, may also find a useful application in other types of constructions differing from the types described above.

While the invention has been illustrated and described as embodied in an arrangement for drawing transverse ribs onto small pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for drawing transverse ribs onto smooth pipes, comprising a punch arranged to produce transverse ribs; a drive provided for driving said punch; a drawing bank carrying smooth pipes to be provided with ribs; driving chain means movable by said punch drive and including at least two continuously rotatable endless driver chains extending at a distance from one another and driving the transverse ribs; driving chain wheels arranged for driving said driver chains at their one end and chain wheels arranged at the other end of the driver chains, said driving chain wheels having a driving shaft with an axis; and a coupling provided between said punch drive and said driving chain wheels at a drawing bank end which is opposite to said punch with said driving chain wheels spaced farther from said punch than said chain wheels at said other end, said coupling including two claw discs which are bringable in form-locking and force-transmitting engagement with one another, one of said claw discs being freely rotatably arranged on said driving shaft and at least indirectly actuatable from said punch drive, the other of said claw discs being connected with said driving shaft for joint rotation therewith, said other claw disc being axially displaceable on said driving shaft under the action of a spring force in one axial direction and under the action of a fluid in the other axial direction of said driving shaft.

2. An arrangement as defined in claim 1; and further comprising a plurality of drivers arranged on said driver chains.

3. An arrangement as defined in claim 1; and further comprising a driving wheel arranged freely rotatably on said driving shaft of said driving chain wheels and being at least indirectly actuatable from said punch drive, said one claw disc being fixedly connected with said driving wheel.

4. An arrangement as defined in claim 1; and further comprising a spring which is arranged so as to displace said other claw disc on said driving shaft in said one direction relative to said one claw disc.

5. An arrangement as defined in claim 1; and further comprising a fluid-operated cylinder-piston unit arranged to axially displace said other claw disc on said driving shaft in said other direction relative to said one claw disc.

6. An arrangement as defined in claim 1, wherein said driving shaft has an axis, each of said claw discs having an end side and being provided at said end side with a plurality of claws, each of said claws having two driving surfaces extending parallel to said axis of said driving shaft and circumferentially spaced from one another, as well as a rectilinear transition surface extending between said two driving surfaces with a small inclination relative to a plane extending transverse to said axis of said driving shaft.

7. An arrangement as defined in claim 1; and further comprising a spring which is arranged to axially displace said other claw disc on said driving shaft in said one direction relative to said one claw disc; a cup-disk abutting against said driving shaft at its one end; a fluid-actuated cylinder-piston unit arranged to axially displace said other claw disc on said driving shaft in said other direction relative to said one claw disc, and having a cylinder; a flange connected with said cylinder of said cylinder-piston unit, said spring being formed as a helical pressure spring and clamped between said cup-disc and said flange.

8. An arrangement as defined in claim 1; and further comprising a fluid-actuated cylinder-piston unit arranged to axially displace said other claw disc on said driving shaft in said other direction relative to said one claw disc and having a cylinder provided with a flange; and means for connecting said other claw disc for joint rotation with said driving shaft and including a groove-spring structure provided between said driving shaft and said flange.

9. An arrangement as defined in claim 8; and further comprising a clamping disc arranged on an end of said driving shaft; and a cup-disc supported on said clamping disc.

10. An arrangement as defined in claim 1, wherein said driving shaft has an end surface; and further comprising a cylinder-piston unit arranged to axially displace said other claw disc on said driving shaft in the other direction relative to said one claw disc and having a cylinder; a flange; a cover disc mounted on said flange, said cylinder-piston unit having a cylinder which is arranged on said cover disc and a piston rod which extends through said cover disc in direction toward said end surface of said driving shaft.

11. An arrangement as defined in claim 1; and further comprising a cylinder-piston unit arranged to axially displace said other claw disc on said driving shaft in said other direction relative to said one claw disc and being formed as a pneumatically actuatable cylinder-piston unit; and a pneumatic rotary throughbearing coupled with said pneumatic cylinder-piston unit.

12. An arrangement for drawing transverse ribs onto smooth pipes, comprising a punch arranged to produce transverse ribs; a drive provided for driving said punch; a drawing bank carrying smooth pipes to be provided with ribs; driving chain means movable by said punch drive and including at least two continuously rotatable endless driver chains extending at a distance from one another and driving the transverse ribs; driving chain wheels arranged for driving said driver chains at their one end and chain wheels arranged at the other end of the driver chains, said driving chain wheels having a driving shaft with an axis; a hollow flange surrounding said driving shaft; a driving wheel arranged freely rotatably on said driving shaft and driven at least indirectly from said punch drive; and a coupling provided between said punch drive and said driving chain wheels at a drawing bank end which is opposite to said punch with said driving chain wheels spaced farther from said punch than said chain wheels at said other end, said coupling including two claw discs which are bringable in form-locking and force-transmitting engagement with one another, one of said claw discs being fixedly connected with said driving wheel, the other of said claw discs being connected with said driving shaft for joint rotation therewith and axially displaceable on said driving shaft under the action of a spring force in one axial direction and under the action of a fluid in the other axial direction of said driving shaft, a spring which is arranged to axially displace said other claw disc on said driving shaft in said one direction relative to said one claw disc and acts upon said hollow flange in said one direction, a fluid-actuated cylinder-piston unit arranged to axially displace said other claw disc on said driving shaft in said other direction relative to said one claw disc and acts upon said hollow flange in said other direction and having a cylinder and a piston rod abutting against said driving shaft, each of said claw discs having an end side and being provided at said end side with a plurality of claws, each of said claws having two driving surfaces extending parallel to said axis of said driving shaft and circumferentially spaced from one another, as well as a rectilinear transition surface extending between said two driving surfaces with a small inclination relative to a plane extending transverse to said axis of said driving shaft.

13. An arrangement as defined in claim 12; and further comprising a clamping ring fixed on said driving shaft and a cup disc supported on said clamping ring, said spring being formed as a helical pressure spring and abutting against said hollow flange and said cup disc.

14. An arrangement as defined in claim 12; and further comprising means for connecting said other claw disc with said driving shaft for joint rotation therewith and including a first connecting formation provided on said driving shaft and a second connecting formation provided on said hollow flange and cooperating with said first connecting formation, one of said connecting formations being formed as a groove and the other of said connecting formations being formed as a projection engaging in said groove.

15. An arrangement as defined in claim 12, wherein said driving shaft has an end surface; and further comprising a cover disc mounted on said hollow flange, said cylinder of said cylinder-piston unit being fixed on said cover disc and said piston rod of said cylinder-piston unit extending through said cover disc in direction towards said end surface of said driving shaft.

* * * * *